United States Patent [19]

Akanuma et al.

[11] Patent Number: 4,929,372

[45] Date of Patent: May 29, 1990

[54] LUBRICATING OIL COMPOSITIONS FOR CHAINS

[75] Inventors: Hideo Akanuma, Tokyo; Masashi Murata, Funabashi; Kiyoshi Inoue, Hiratsuka; Ryoji Ohgake, Yachimata, all of Japan

[73] Assignees: Asahi Glass Co., Ltd.; Nippon Oil Co., Ltd., both of Tokyo, Japan; a part interest

[21] Appl. No.: 356,795

[22] Filed: May 23, 1989

[30] Foreign Application Priority Data

May 26, 1988 [JP] Japan ..... 63-127172

[51] Int. Cl.[5] ..... C10M 125/02

[52] U.S. Cl. ..... 252/29; 252/565

[58] Field of Search ..... 252/565, 29

[56] References Cited

U.S. PATENT DOCUMENTS

| | | | |
|---|---|---|---|
| 3,607,747 | 9/1971 | Ishikaw et al. | 252/18 |
| 3,856,686 | 12/1974 | Sato et al. | 252/30 |
| 4,049,563 | 10/1977 | Burrous | 252/49.9 |
| 4,212,816 | 7/1980 | Hentschel et al. | 260/410 |
| 4,354,948 | 10/1982 | Schoch et al. | 252/22 |

*Primary Examiner*—William R. Dixon, Jr.
*Assistant Examiner*—Rhonda R. Brown
*Attorney, Agent, or Firm*—Bucknam and Archer

[57] ABSTRACT

A lubricating oil composition for chains which comprises (A) as the base oil, a polyol ester represented by the general formula

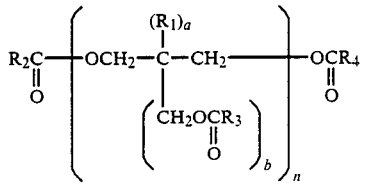

wherein $R_1$ is an alkyl group having 1 to 4 carbon atoms, $R_2$ to $R_4$ are each an alkyl group having 2 to 17 carbon atoms, a and b are each an integer of 0 to 2 with the proviso that the total of a and b is 2, and n is an integer of 1 to 4, and (B) as an additive, a graphite fluoride represented by the experimental formula $CF_x$ wherein x is a number of 0.5 to 1.2, in a specified amount of 0.5 to 30% by weight of the composition.

6 Claims, No Drawings

LUBRICATING OIL COMPOSITIONS FOR CHAINS

BACKGROUND OF THE INVENTION

1. Field of the Invention

The present invention relates to a lubricating oil composition for chains and more particularly to such a lubricating oil composition which is adapted to be used at a high temperature of 150° C. or above.

2. Prior Art

In the step of molding glass fibers, baking bread, baking coating materials applied to automobiles, or the like, a large-sized chain is generally used for a conveyor for sending the objects to be treated into a heating oven and a part of the chain enters the oven so very often it is exposed to a high temperature of 150° C. or above.

Conventional lubricating oils are unsuitable for use as lubricating oils used at such a high temperature and therefore a dispersion of graphite in a solvent such as triethylene glycol has instead been used as the latter lubricating oil. However, solvents such as triethylene glycol only function as a dispersant for graphite and will soon be lost by evaporation and/or thermal decomposition as soon as a lubricated chain enters into a high-temperature atmosphere such as a heating oven, if the solvents are used with graphite to form a lubricant for the chain. Accordingly, it is only graphite in this lubricant that substantially acts as a lubricant.

In the case when such a lubricant is used in such a chain, the graphite merely adheres to the surface of the chain and is therefore apt to be removable from it, thus requiring a more frequent supply of the lubricant. Further, this raises problems because the heating oven in which the chain has entered is filled with vapors of the solvent and thermal decomposition products aggravate the working environment and the exhaustion of the vapors into the atmosphere causes environmental pollution.

SUMMARY OF THE INVENTION

The inventors of the present invention have eagerly studied in to overcome the above problems as to the conventional lubricants for use in chains and, as the result of their studies, have found that a lubricating oil composition for chains having excellent performance can be obtained by adding a specified amount of graphite fluoride as an essential component to a polyol ester having a specified structure as the base oil. The present invention has been accomplished on the basis of this finding.

The primary object of the present invention is to provide a lubricating oil composition for chains which will exhibit excellent heat stability, coking resistance, load resistance and lubricity even when it is used at a high temperature of 150° C. or above.

The above object of the present invention can be attained by the provision of a lubricating oil composition for chains which will be described hereinbelow.

The lubricating oil composition for chains according to the present invention comprises (A) as the base oil, a polyol ester represented by the general formula

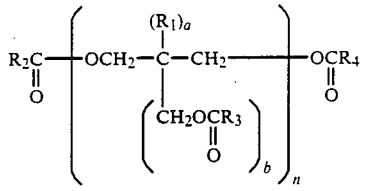

wherein $R_1$ is an alkyl group having 1 to 4 carbon atoms, $R_2$ to $R_4$ are each an alkyl group having 2 to 17 carbon atoms, a and b are each an integer of 0 to 2 with the proviso that the total of a and b is 2, and n is an integer of 1 to 4, and (B) as an additive, a graphite fluoride represented by the experimental formula $CF_x$ wherein x is a number of 0.5 to 1.2, in an amount of 0.5 to 30% by weight based on the total amount of the composition.

The present invention will be described in more detail hereinbelow.

In the formula of the base oil, $R_1$ is an alkyl group having 1 to 4, preferably 1 to 2, carbon atoms; $R_2$ to $R_4$ are each an alkyl group having 2 to 17, preferably 2 to 12, carbon atoms; and a, b and n are each as defined above. If a polyol ester which does not satisfy even any one of the above requirements is used, no lubricating oils having the desired properties will be obtained.

In the formula of the base oil, $R_1$ includes methyl, ethyl, propyl or butyl group, among which methyl or ethyl group is particularly preferred. Each of $R_2$ to $R_4$ includes ethyl, propyl, butyl, pentyl, hexyl, heptyl, octyl, nonyl, decyl, undecyl, dodecyl, tridecyl, tetradecyl, pentadecyl, hexadecyl or heptadecyl group, among which ethyl, propyl, butyl, pentyl, hexyl, heptyl, octyl, nonyl, decyl or dodecyl group is particularly preferred.

As described above, the polyol ester (A) to be used in the present invention is an ester of a polyol wherein the $\beta$-carbon (second carbon) atom of the alcoholic moiety of the ester linkage is a tertiary one, with an aliphatic monocarboxylic acid having 3 to 18, preferably 3 to 13, carbon atoms. The polyol includes neopentyl glycol, trimethylolethane, trimethylolpropane, pentaerythritol, dimer to tetramer thereof or a mixture thereof. On the other hand, the aliphatic monocarboxylic acid includes a straight- or branched-chain aliphatic monocarboxylic acid having 3 to 18, preferably 3 to 13, carbon atoms. More specifically, the aliphatic monocarboxylic acid is exemplified by a straight-chain fatty acid such as butanoic, caproic, caprylic, capric or lauric acid, which can be prepared by the decomposition of an oil or fat; a straight-chain $C_7$ or $C_9$ acid, a branched-chain acid or a neopentyl type branched-chain acid, which can be prepared by synthesis, or a mixture thereof.

Although the polyol ester (A) to be used in the present invention may be any compound having the structure represented by the above formula, it is practically preferred that said polyol ester have a kinematic viscosity at 100° C. of 6 to 40 cSt.

Meanwhile, the graphite fluoride (B) to be used as a solid lubricant (which is an essential component) in the lubricating oil composition according to the present invention is represented by the experimental formula $CF_x$, wherein x is a number of 0.5 to 1.2, preferably 0.8 to 1.0. When a graphite fluoride of the formula wherein x is less than 0.5 is used, the resulting lubricating oil composition will be unfavorably poor in lubricity. Further, it is difficult to prepare a graphite fluoride of the formula wherein x exceeds 1.2.

The graphite fluoride (B) is a substance which is also called "carbon fluoride", "fluorocarbon" or "white carbon". It can be prepared by, for example, reacting a carbonaceous material such as natural or synthetic graphite, activated carbon or coke with fluorine or its compound at a high temperature.

Although the graphite fluoride (B) to be used in the present invention may have an arbitrary particle size, it is preferred from the standpoint of dispersibility in the polyol ester (A) that it have a particle size of 0.03 to 5 μm.

According to the present invention, the amount of the graphite fluoride (B) used is 0.5 to 30% by weight, preferably 5 to 10% by weight, based on the total amount of the resulting lubricating oil composition. If the amount of the component (B) is less than the lower limit, the resulting composition will exhibit insufficient wear-preventive and insufficient failure-preventive properties. On the other hand, if the amount of the component (B) exceeds the upper limit, the resulting composition will not be improved in such preventive properties for the excessive amount and will unfavorably cause an increase in viscosity.

Although the lubricating oil composition of the present invention consisting solely of the polyol ester (A) as the base oil and the graphite fluoride (B) as the essential additive, will of course exhibit excellent performances as such, with other known additives for lubricating oils for the purpose of further improving the performance.

The known additives include aromatic amine-type antioxidants such as phenyl-α-naphthylamine and 4,4'-tetramethyldiaminodiphenylmethane; phenol-type antioxidants such as 2,6-di-t-butyl-p-cresol and 4,4'methylenebis(2,6-di-t-butylphenol); organozinc-type antioxidants such as zinc dialkyldithiophosphates, zinc dialkylaryldithiophosphates and zinc dialkyldithiocarbamates; and viscosity index improvers such as non-dispersion-type polymethacrylates, dispersion-type polymethacrylates, polyisobutylene, ethylene-propylene copolymers and polyalkylstyrene.

Although the amount of the above known additives may be arbitrary, it is generally preferred that the amount of the antioxidant be 0.1 to 2% by weight based on the total amount of the resulting composition, while that of the viscosity index improver be 2 to 20% by weight based thereon.

PREFERRED EMBODIMENTS

The present invention will now be described in more detail by referring to the following Examples and Comparative Examples.

EXAMPLES 1 TO 4 AND COMPARATIVE EXAMPLES 1 TO 8

(Evaluation of lubricating performances of various lubricating oil compositions by the FALEX test)

The kinematic viscosities of the base oils used in the Examples and Comparative Examples are shown in Table 1.

To evaluate the wear-preventive property and load resistance of the lubricating oil composition of each of Examples 1–4 and Comparative Examples 1–8, 5% by weight (based on the total amount of the composition) of a solid lubricant as given in Table 2 was added to a base oil as given therein to prepare a lubricating oil composition. The lubricating oil compositions thus obtained (Examples 1 to 4 and Comparative Examples 1 to 8) were examined for their ability to prevent wear (in amount) and failure (in load) by the FALEX test according to ASTM D 3233 under the test conditions described below. The results are shown in Table 2.

| Test conditions | |
|---|---|
| (wear test) | oil temperature: 80° C.<br>load: 250 lb<br>time: 1 hr |
| (failure load test) | oil temperature: 80° C. |

EXAMPLES 5 TO 7 AND COMPARATIVE EXAMPLES 9 TO 12

(Evaluation of thermal stability of various lubricating oil compositions)

To evaluate the thermal stability and thermal decomposition-initiating temperature of the lubricating oil composition of each of Examples 5–7 and Comparative Examples 9–12, 5% by weight (based on the total amount of the composition) of graphite fluoride B (having an experimental formula of CF and a particle size of 3 to 5 μm) was added to a base oil as given in Table 3. The lubricating oil compositions thus obtained (Examples 5 to 7 and Comparative examples 9 to 12) were examined for their thermal stability (evaporation loss and increase in acid value) according to JIS K 2540 and for their thermal decomposition-initiating temperature according to the DSC method under the test conditions described below. The results are shown in Table 3.

| Test conditions | |
|---|---|
| (thermal stability) | temperature: 160° C.<br>time: 120 hr |
| (thermal decomposition-initiating temperature) | temperature rise rate: 4° C./min<br>in air |

TABLE 1

| Base oil | Kinematic viscosity cSt at 100° C. |
|---|---|
| Pentaerythritol dimer 2-ethylhexyl ester (Ester A) | 14.5 |
| Pentaerythritol monomer 2-ethylhexyl decyl ester (Ester B) | 6.9 |
| Pentaerythritol dimer i-nonyl ester (Ester C) | 26.4 |
| 1-decene oligomer (poly-α-olefin) | 5.5 |
| $C_{16-18}$monoalkylnaphthalene (alkylnaphthalene) | 5.1 |
| SAE 20 (refined mineral oil) | 7.4 |
| Triethylene glycol | 3.3 |

TABLE 2

| Examples/ Comp. Examples | Base oil | Solid lubricant | Amount of wear (mg) | Failure load (lb) |
|---|---|---|---|---|
| Example 1 | Ester A | Graphite fluoride A*1 | 4.8 | 1370 |
| Example 2 | Ester A | Graphite fluoride B*2 | 6.5 | 1250 |
| Example 3 | Ester B | Graphite fluoride A*1 | 6.2 | 1600 |
| Example 4 | Ester C | Graphite fluoride A*1 | 2.0 | 1540 |
| Comp. Example 1 | Ester A | Graphite | 23.9 | 810 |
| Comp. Example 2 | Ester A | Molybdenum disulfide | 24.9 | 1400 |
| Comp. Example 3 | Ester A | Tungsten disulfide | 26.4 | 860 |
| Comp. Example 4 | Ester A | Teflon (trade name) | 27.2 | 780 |
| Comp. Example 5 | Poly-α-olefin | Graphite fluoride A*1 | 9.3 | 1380 |
| Comp. Example 6 | Alkyl-naphthalene | Graphite fluoride A*1 | 8.7 | 1100 |
| Comp. Example 7 | Refined mineral oil | Graphite fluoride A*1 | 9.6 | 1080 |
| Comp. Example 8 | Triethylene glycol | Graphite fluoride A*1 | 14.5 | 900 |

*1: Experimental formula CF, particle size: <1 μm
*2: Experimental formula CF, particle size: 3 to 5 μm

TABLE 3

| Comp. Examples | Base oil | Solid lubricant | Thermal stability: Evaporation loss (%) | Thermal stability: Increase in acid value (mg KOH/g) | Thermal decomposition initiating temperature (°C.) |
|---|---|---|---|---|---|
| Example 5 | Ester A | Graphite fluoride B*1 | 7.8 | 2.5 | 290 |
| Example 6 | Ester B | Graphite fluoride B*1 | 6.7 | 4.0 | 285 |
| Example 7 | Ester C | Graphite fluoride B*1 | 9.6 | 2.7 | 315 |
| Comp. Example 9 | Poly-α-olefin | Graphite fluoride B*1 | 13.6 | 3.1 | 232 |
| Comp. Example 10 | Alkylnaphthalene | Graphite fluoride B*1 | 15.0 | 0.23 | 275 |
| Comp. Example 11 | Refined mineral oil | Graphite fluoride B*1 | 9.9 | 0.75*2 | 230 |
| Comp. Example 12 | Triethylene glycol | Graphite fluoride B*1 | 100 | — | 205 |

*1: Experimental formula CF, particle size: 3 to 5 μm
*2: Sludge generated in a large amount.

The results of the FALEX test shown in Table 2 reveal that the use of the composition of any of Examples 1 to 4 gave small wear and high failure load, i.e., said composition is excellent in wear-preventive property and load resistance, while the use of the composition of any of Comparative Examples 1 to 8 gave higher wear than those given by using the composition of Examples 1 to 4. Further, they reveal that the compositions of Comparative Examples 1, 3, 4, 6, 7 and 8 gave lower failure load than those of Examples 1 to 4. Thus, it can be understood from the results that it is difficult to put any of the compositions of Comparative Examples 1 to 8 to practical use.

Further, the results of the evaluation of thermal stability shown in Table 3 reveal that the compositions of Comparative Examples 9 to 12 gave a greater evaporation loss of the base oil than those of Examples 5 to 7, and particularly the composition of Comparative Example 12 was completely freed of the base oil by the evaporation thereof whereby it was entirely unusable and that the composition of Comparative Example 11 generated a large amount of sludge thereby to fail in the practical use thereof. Further, the results of thermal decomposition-initiating temperature shown in Table 3 reveal that the thermal decomposition-initiating temperatures of the compositions of Examples 5 to 7 were all high enough to permit their use at high temperatures, though those of the compositions of Comparative Example 9 to 12 were too low to be used at a high temperature.

Effect of the Invention

As described above, the lubricating oil composition for chains of the present invention is excellent in wear resistance, load resistance, lubricity, heat stability and the like, and it can therefore be used stably even at a high temperature of 150° C. or above.

What is claimed is:

1. A lubricating oil composition for chains which consists essentially of (A) as the base oil, a polyol ester represented by the general formula

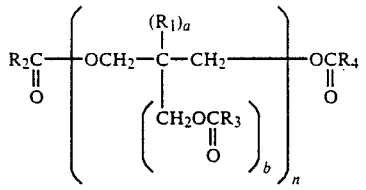

wherein $R_1$ is an alkyl group having 1 to 4 carbon atoms, $R_2$ to $R_4$ are each an alkyl group having 2 to 17 carbon atoms, a and b are each an integer of 0 to 2 with the proviso that the total of a and b is 2, and n is an integer of 1 to 4, and (B) as an additive, a graphite fluoride represented by the formula $CF_x$ wherein x is a number of 0.5 to 1.2, in an amount of 0.5 to 30% by weight based on the total amount of the composition.

2. A lubricating oil composition according to claim 1, wherein the polyol ester is an ester of pentaerythritol monomer or dimer with aliphatic monocarboxylic acids.

3. A lubricating oil composition according to claim 1, wherein $R_2$ to $R_4$ are each an alkyl group having 2 to 12 carbon atoms.

4. A lubricating oil composition according to claim 1, wherein the polyol ester has a kinematic viscosity at 100° C. of 6 to 40 cSt.

5. A lubricating oil composition according to claim 1, wherein the graphite fluoride has a particle size of 0.03 to 5 μm.

6. The composition according to claim 1 is stable at a temperature of 150° C. or higher.

* * * * *